US010857439B1

(12) United States Patent
Yang et al.

(10) Patent No.: US 10,857,439 B1
(45) Date of Patent: Dec. 8, 2020

(54) POWER-SAVING LUMINOUS BASKETBALL HOOP SET

(71) Applicant: JIAO HSIUNG INDUSTRY CORP., New Taipei (TW)

(72) Inventors: Yung-Hao Yang, New Taipei (TW); Kun-Cheng Wu, Changhua (TW)

(73) Assignee: JIAO HSIUNG INDUSTRY CORP., New Taipei (TW)

( * ) Notice: Subject to any disclaimer, the term of this patent is extended or adjusted under 35 U.S.C. 154(b) by 0 days.

(21) Appl. No.: 16/580,063

(22) Filed: Sep. 24, 2019

(30) Foreign Application Priority Data

Aug. 14, 2019 (TW) ..... 108129009 A

(51) Int. Cl.

| | |
|---|---|
| ***A63B 63/08*** | (2006.01) |
| ***A63B 71/06*** | (2006.01) |
| ***H05B 45/10*** | (2020.01) |
| ***F21V 23/00*** | (2015.01) |
| ***F21V 23/04*** | (2006.01) |
| *F21Y 115/10* | (2016.01) |

(52) U.S. Cl.
CPC ..... *A63B 63/083* (2013.01); *A63B 71/0622* (2013.01); *F21V 23/008* (2013.01); *F21V 23/0492* (2013.01); *H05B 45/10* (2020.01); *A63B 2071/0694* (2013.01); *A63B 2220/801* (2013.01); *A63B 2220/833* (2013.01); *A63B 2225/74* (2020.08); *F21Y 2115/10* (2016.08)

(58) Field of Classification Search
CPC ..... A63B 63/083; A63B 71/0622; A63B 2071/0694; A63B 2220/801; A63B 2220/803; F21V 23/008; F21V 23/0492
See application file for complete search history.

(56) References Cited

U.S. PATENT DOCUMENTS

| | | | | |
|---|---|---|---|---|
| 4,984,787 | A * | 1/1991 | Nesbit | A63B 63/083 473/481 |
| 5,305,998 | A * | 4/1994 | Nesbit | A63B 63/083 473/481 |
| 6,554,724 | B2 * | 4/2003 | Taylor | A63B 71/0669 473/447 |
| 7,427,244 | B1 * | 9/2008 | Patel | A63B 69/0071 473/447 |
| 9,632,238 | B2 * | 4/2017 | Li | G02B 6/0091 |
| 2002/0049102 | A1 * | 4/2002 | Taylor | A63B 24/0021 473/447 |
| 2008/0176679 | A1 * | 7/2008 | Chin | A63B 63/083 473/481 |

(Continued)

*Primary Examiner* — David L Lewis
*Assistant Examiner* — Matthew D Hoel
(74) *Attorney, Agent, or Firm* — Birch, Stewart, Kolasch & Birch, LLP

(57) ABSTRACT

A power-saving luminous basketball hoop set has a base, an illuminating module, and a basketball hoop assembly. The base has a cavity. The illuminating module is mounted in the cavity and has a control circuit module and an LED module electrically connected to each other. The control circuit module has a vibration sensor and an MCU. The basketball hoop assembly is fixed in the base and has a light-transmitting backboard and a rim assembly fixed on the light-transmitting backboard. The light-transmitting backboard is inserted in the cavity and is adjacent to the LED module. The power-saving luminous basketball hoop set can be automatically lighted up by detecting vibration.

20 Claims, 8 Drawing Sheets

(56) References Cited

U.S. PATENT DOCUMENTS

2016/0170134 A1* 6/2016 Li ..... G02B 6/0091
349/65
2020/0009443 A1* 1/2020 Moravchik ..... G06K 9/00201

* cited by examiner

POWER-SAVING LUMINOUS BASKETBALL HOOP SET

BACKGROUND OF THE INVENTION

1. Field of the Invention

The present invention relates to a basketball hoop, and more particularly to a power-saving luminous basketball hoop set which can be lighted up automatically by detecting vibration.

2. Description of Related Art

A conventional basketball hoop set substantially comprises a backboard and a rim fixed on a front surface of the backboard. The backboard has a target square painted on the front surface thereof for users to aim at when shooting a basketball. However, when playing basketball at night or in a poorly lit place with the conventional basketball hoop set, the rim and the target square of the basketball hoop cannot be seen clearly. In order to use the conventional basketball hoop at night or in a dark place, a lighting device is required. However, the backboard of the conventional basketball hoop set is monotonous and less attractive in its appearance.

To overcome the shortcomings, the present invention tends to provide a power-saving luminous basketball hoop set to mitigate or obviate the aforementioned problems.

SUMMARY OF THE INVENTION

The main objective of the invention is to provide a power-saving luminous basketball hoop set, which has a built-in illuminating module. The illuminating module can be turned on by detecting vibration and can be automatically turned off when no vibration has been detected within a preset period of time.

A power-saving luminous basketball hoop set has a base, an illuminating module, and a basketball hoop assembly. The base has a cavity recessed in the base and having a mouth formed in an end of the base. The illuminating module is mounted in the cavity of the base and has a power supply module, a control circuit module, and a light-emitting diode module (LED module). The control circuit module is electrically connected to the power supply module and has a vibration sensor generating a vibration signal by detecting a vibration and a microcontroller unit (MCU) electrically connected to the vibration sensor and generating a control signal according to the vibration signal. The LED module is electrically connected to the control circuit module, receives the control signal, and has at least one light-emitting diode (LED) facing the mouth of the base. The basketball hoop assembly is fixed in the base and has a light-transmitting backboard inserted in the cavity of the base via the mouth and being adjacent to the at least one LED of the LED module and a rim assembly fixed on the light-transmitting backboard.

Other objects, advantages and novel features of the invention will become more apparent from the following detailed description when taken in conjunction with the accompanying drawings.

DETAILED DESCRIPTION OF PREFERRED EMBODIMENT

Figure 1:
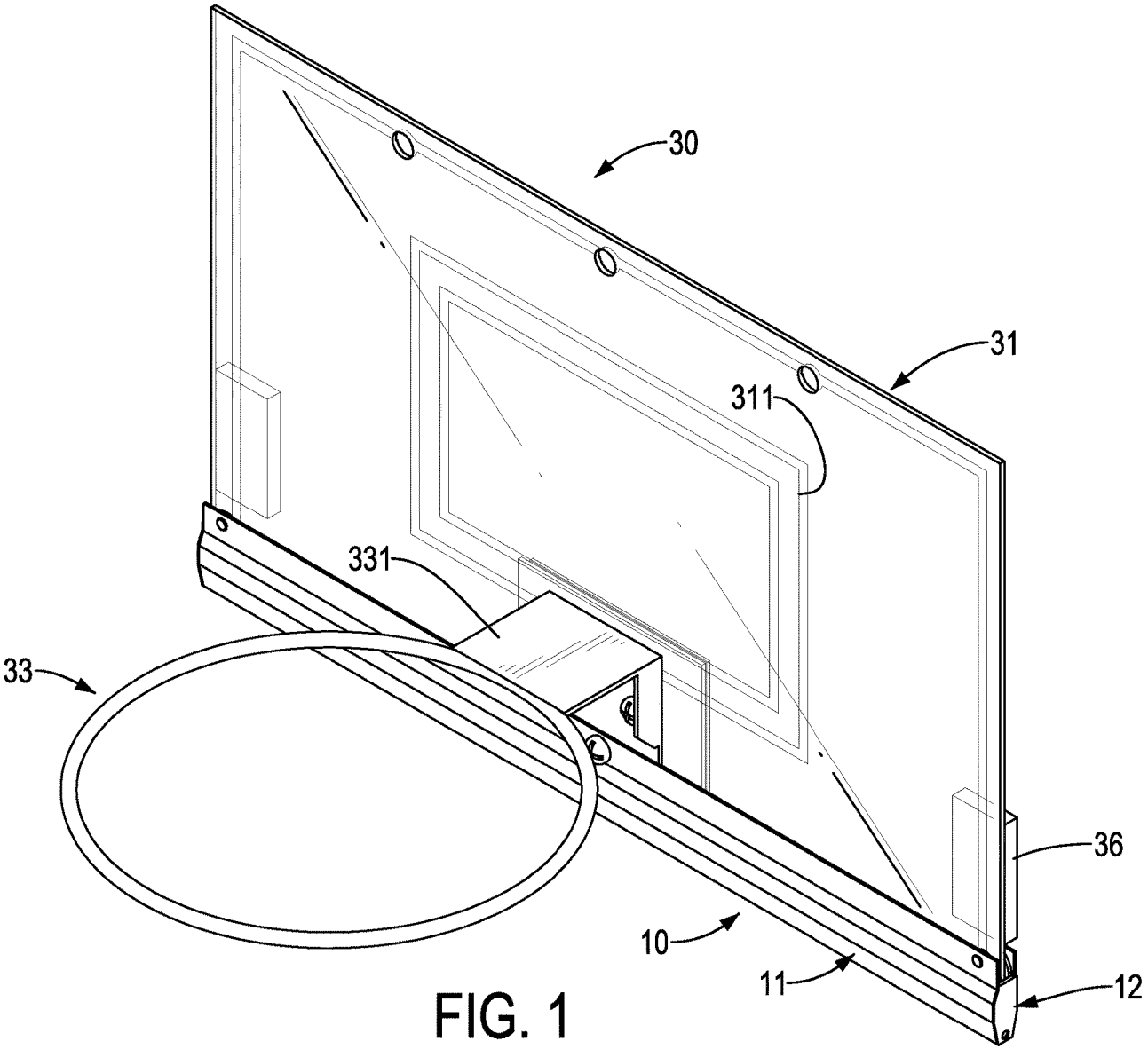
FIG. 1 is a perspective view of a power-saving luminous basketball hoop set in accordance with the present invention.
Figures 2, 2A:
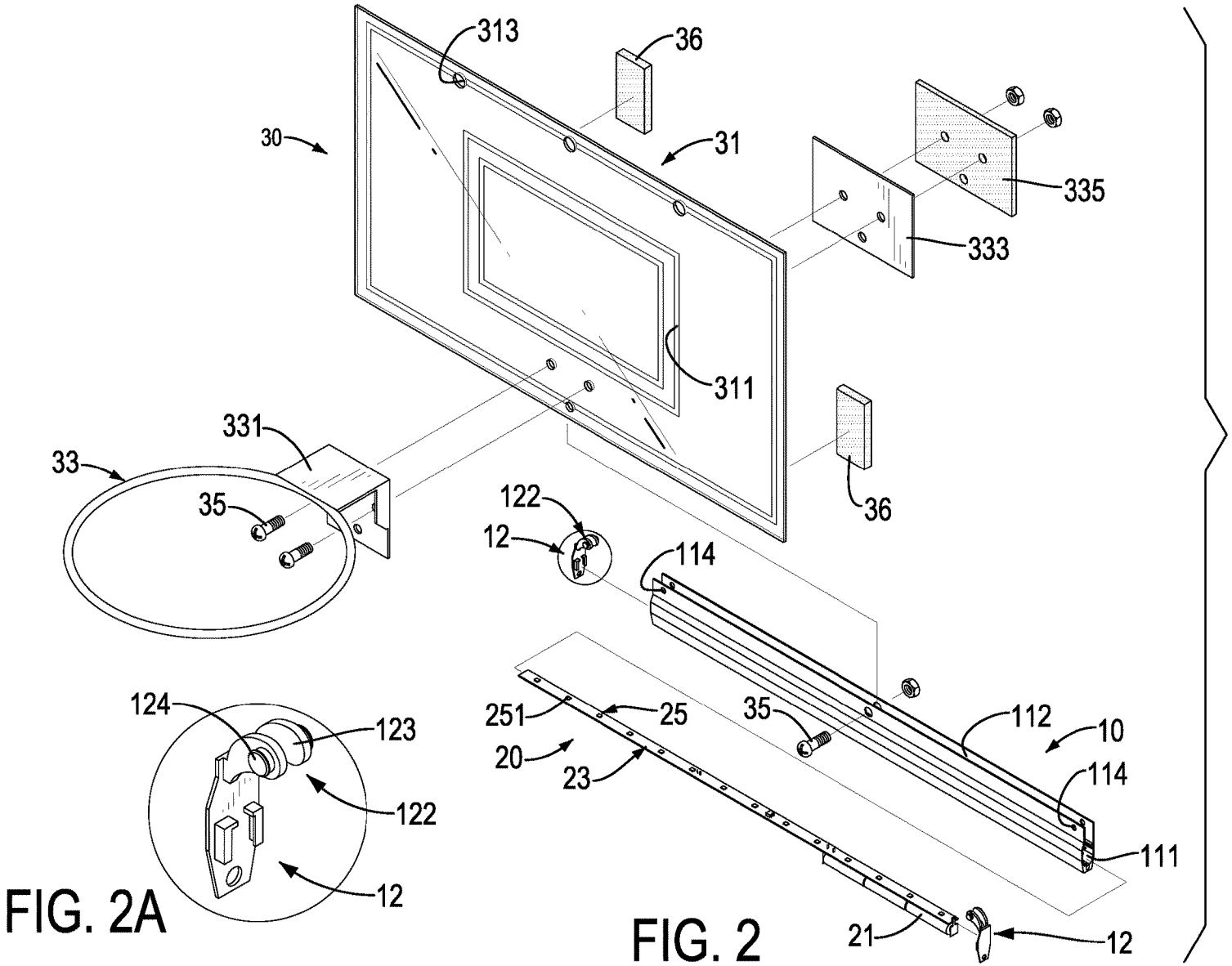
FIG. 2 is an exploded perspective view of the basketball hoop set in FIG. 1.
FIG. 2A is an enlarged perspective view of the basketball hoop set in FIG. 2.
Figure 3:
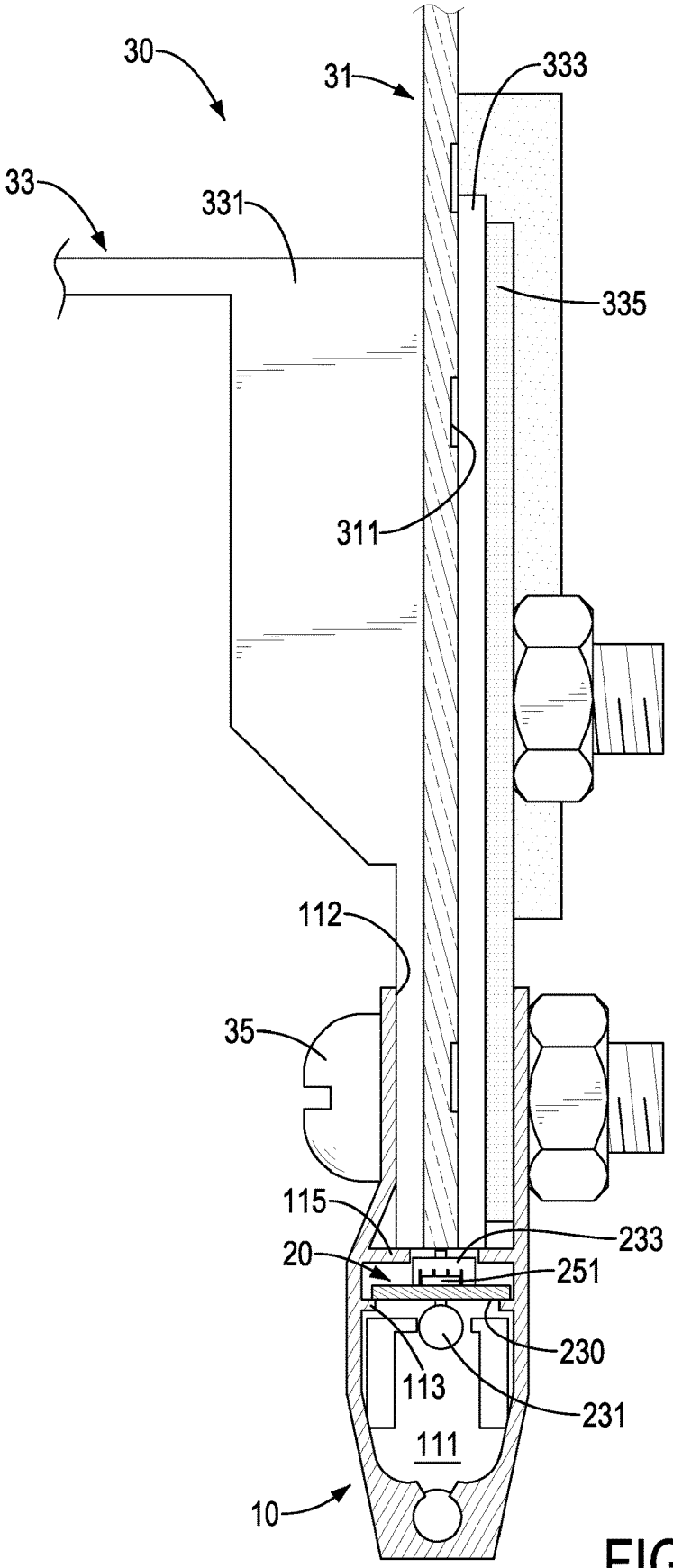
FIG. 3 is an enlarged side view in partial section of the basketball hoop set in FIG. 1.

With reference to FIGS. 1 to 3, a power-saving luminous basketball hoop set in accordance with the present invention has a base 10, an illuminating module 20, and a basketball hoop assembly 30.

The base 10 has a cavity 111. The cavity 111 is recessed in the base 10 and has a mouth 112 formed in an end of the base 10. In the embodiment, the base 10 has a main body 11 and two end caps 12. The cavity 111 is recessed in the main body 11 and the mouth 112 is formed in the top of the main body 11. The cavity 111 has two end openings respectively formed in longitudinal opposite ends of the main body 11. The end caps 12 respectively cover the opposite ends of the main body 11 and close the end openings formed in the main body 11. Each end cap 12 may further have an engaging portion 122. The engaging portion 122 protrudes from a side of the end cap 12 facing the main body 11 and has two fins 123 and two protrusions 124. The fins 123 are arranged at a spaced interval, are inserted in the cavity 111, and respectively abut opposite sides of the cavity 111. The protrusions 124 each protrude from a side of a respective one of the fins 123 away from the other fin 123. The cavity 111 has engaging recesses 114 respectively recessed in the opposite sides of the cavity 111 and corresponding to the protrusions 124 in position. The protrusions 124 are engaged with the engaging recesses 114 to fix the engaging portions 122 of the end caps 12. The fixing structure between the end caps 12 and the main body 11 is not limit thereto. The end cap 12 may be fixed in the main body 11 by other means such as buckling, fastening, adhering, and so on.

Figures 4, 4A, 4B:
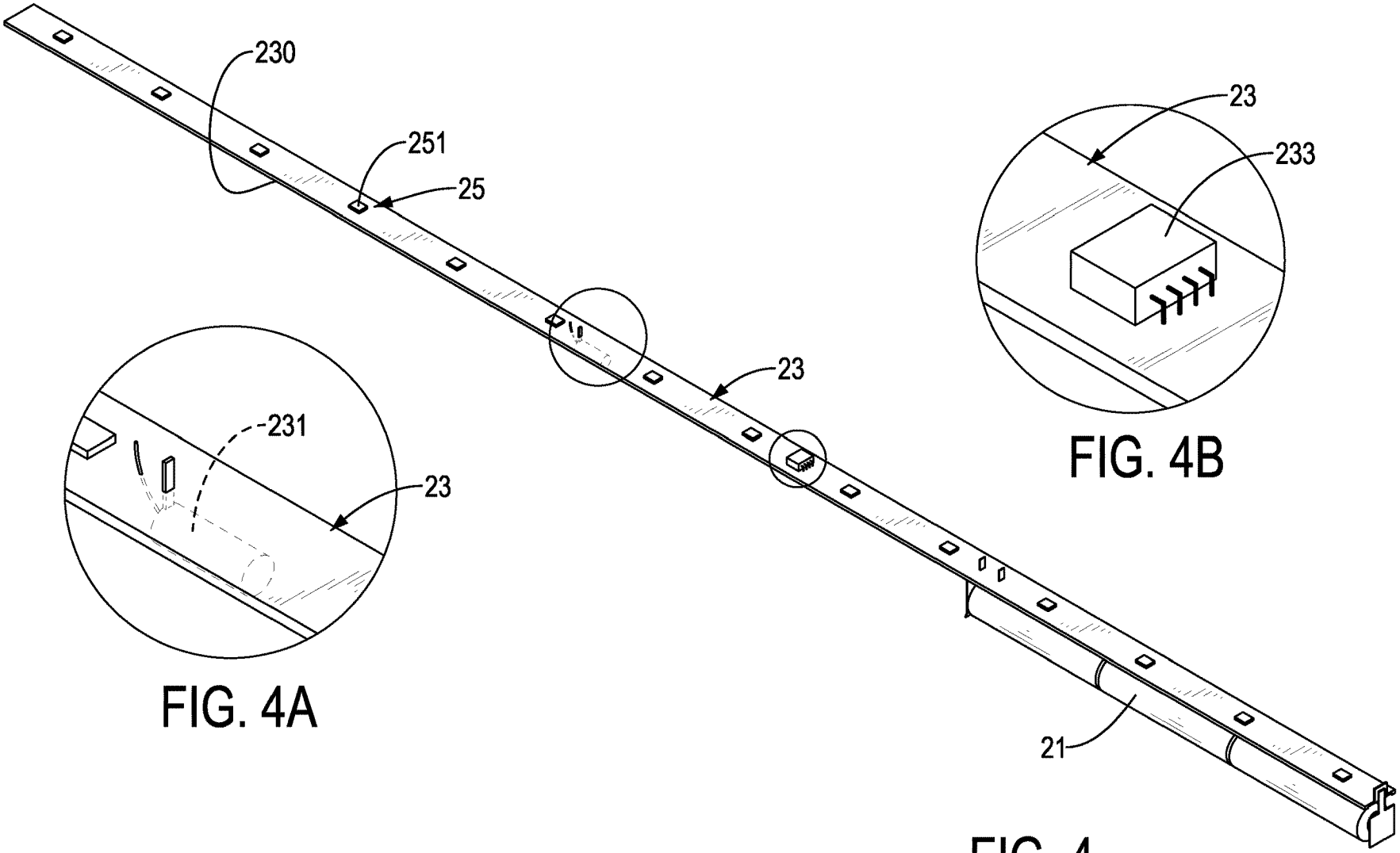
FIG. 4 is a perspective view of the illuminating module of the basketball hoop set in FIG. 1.
FIGS. 4A and 4B are enlarged perspective views of the illuminating module of the basketball hoop set in FIG. 4.

With reference to FIGS. 2 to 4, the illuminating module 20 is mounted in the cavity 111 of the base 10 and has a power supply module 21, a control circuit module 23 and a light-emitting diode module (LED module) 25. The power supply module 21 supplies electric power to the illuminating module 20 and may be a built-in battery module or an external power supplier. The control circuit module 23 is electrically connected to the power supply module 21 and the LED module 25 and has a print circuit board (PCB) 230, a vibration sensor 231, and a microcontroller unit (MCU) 233. The vibration sensor 231 and the MCU 233 are mounted on the PCB 230. The vibration sensor 231 generates a vibration signal by detecting a vibration. The MCU 233 is electrically connected to the vibration sensor 231 and receives the vibration signal. After the MCU 233 receives the vibration signal, the MCU 233 will process calculations and determinations according to program commands stored in the MCU 233 to generate a control signal. The LED module 25 is electrically connected to the control circuit module 23, and receives the control signal to perform a preset action. The LED module 25 may be directly mounted on the PCB 230 or another module electrically connected to the PCB 230. The LED module 25 has at least one light-emitting diode (LED) 251 facing the mouth 112 of the base 10. In the embodiment, the LED module 25 has multiple LEDs 251 arranged along the longitudinal direction of the base 10 at spaced intervals.

Figure 5A:
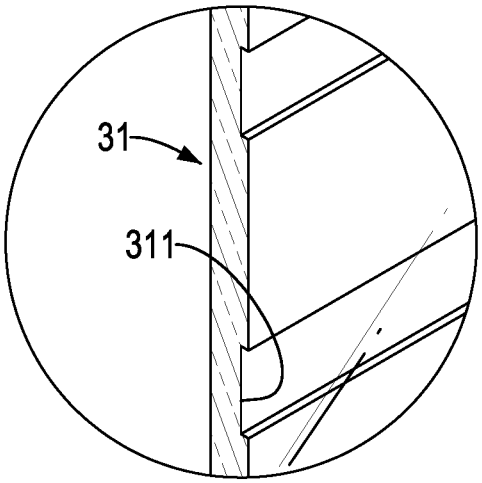
FIG. 5A is an enlarged perspective view of the light-transmitting backboard of the basketball hoop set in FIG. 5.
Figure 5:
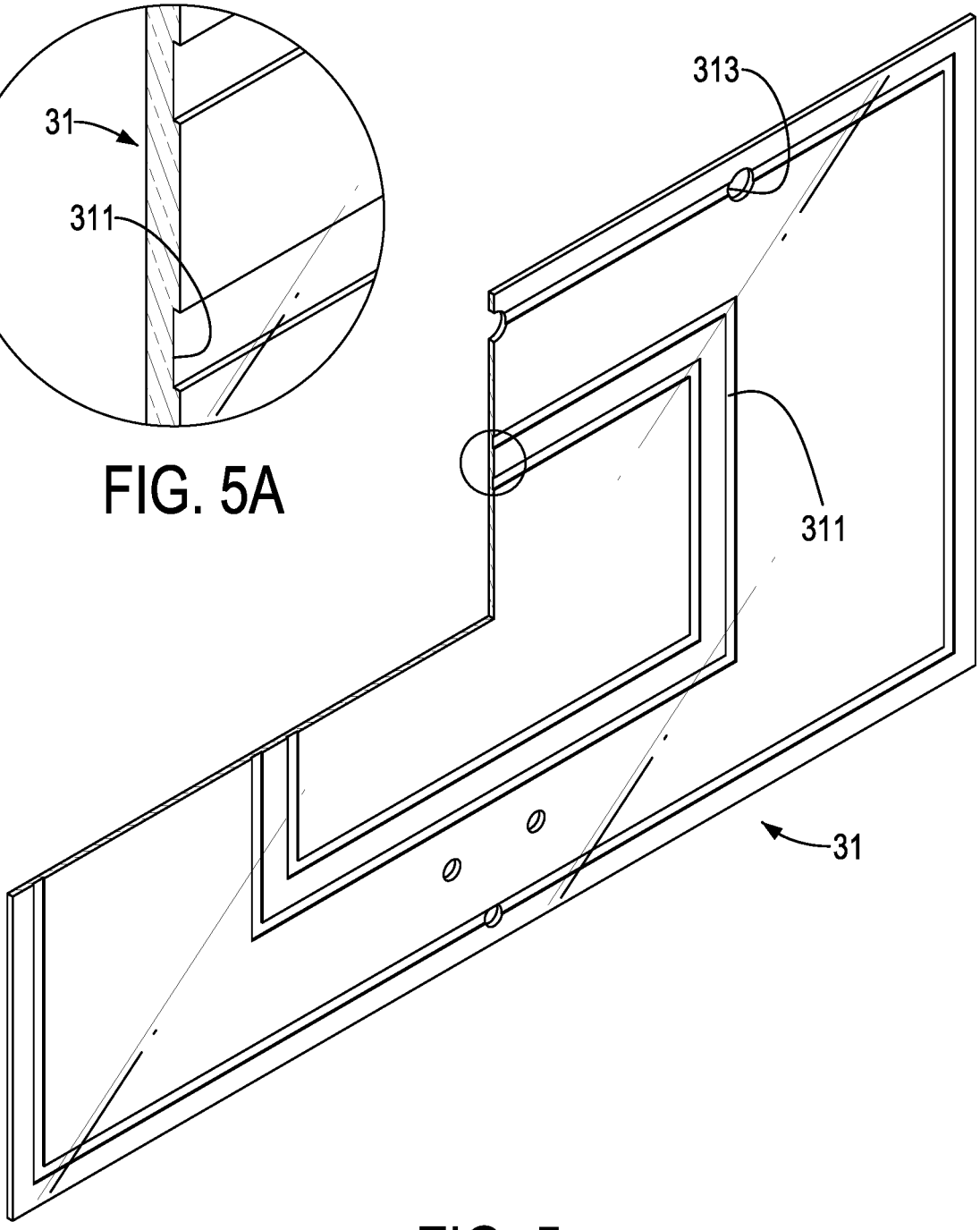
FIG. 5 is a perspective view in partial section of the light-transmitting backboard of the basketball hoop set in FIG. 1.
Figure 6:
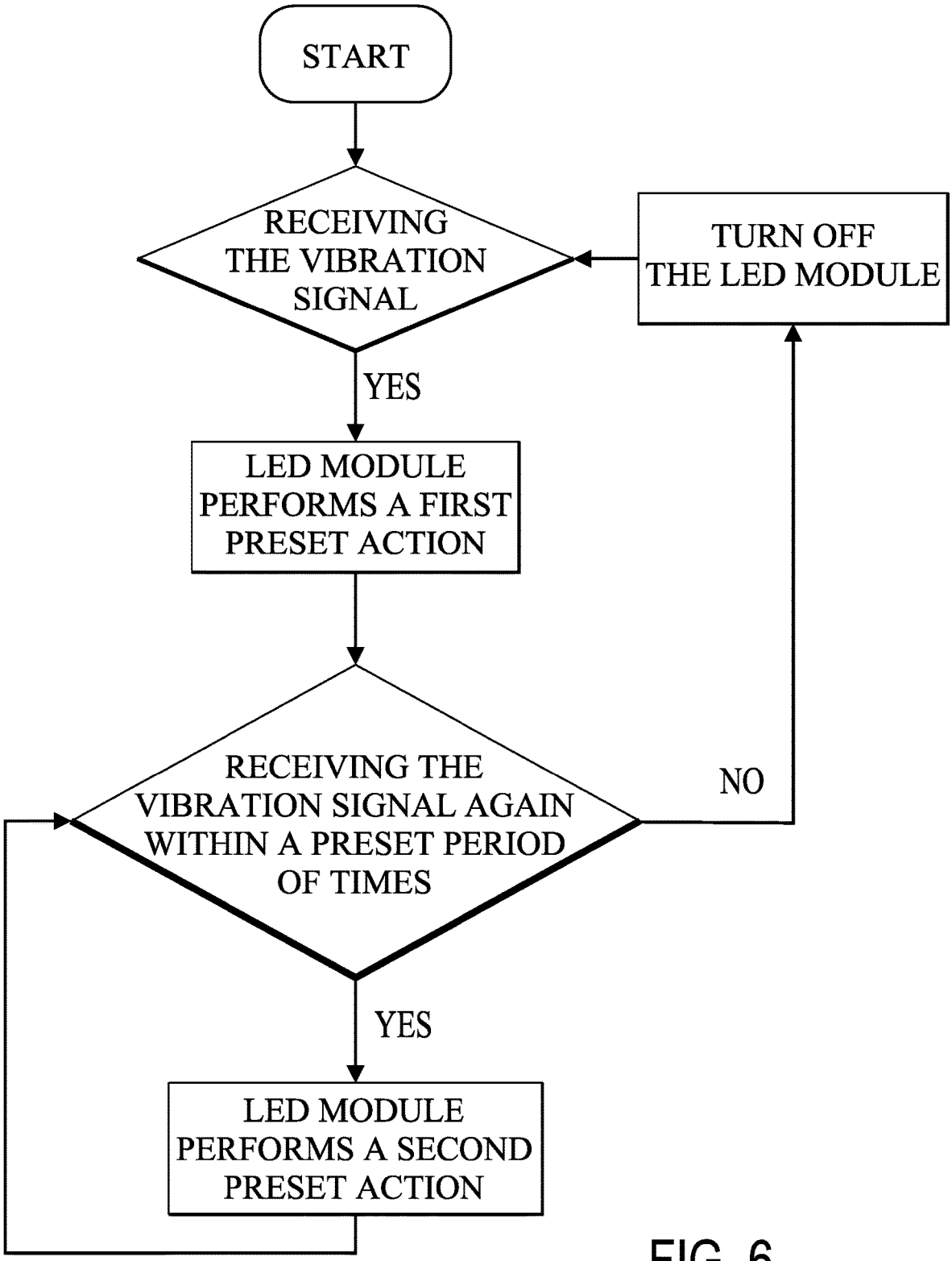
FIG. 6 is a flow chart showing operation of the lighting device of the basketball hoop set in FIG. 1.

With reference to FIGS. 2, 3, and 5, the basketball hoop assembly 30 is fixed in the base 10 by at least one fastener 35. The basketball hoop assembly 30 has a light-transmitting backboard 31 and a rim assembly 33. The light-transmitting backboard 31 is inserted in the cavity 111 of the base 10 via the mouth 112 and are adjacent to the LEDs 251. The rim assembly 33 is fixed on the light-transmitting backboard 31. Preferably, the rim assembly 33 has a front rim 331 and a fixed base 333. The front rim 331 and the fixed base 333 are respectively disposed on opposite sides of the light-transmitting backboard 31, and are inserted in the cavity 111 of the base 10. The front rim 331, the light-transmitting backboard 31, and the fixed base 333 are connected with each other by multiple fasteners 35, and the basketball hoop assembly 30 and the base 10 are connected with each other by a fastener 35. The basketball hoop assembly 30 may further have at least one cushion 335, 36. The cushion 335 may be attached on a side of the fixed base 333 away from the front rim 331, or the at least one cushion 36 may be attached on a side of the light-transmitting backboard 31 away from the front rim 331 to reduce gaps and absorb vibrations.

Figure 7:
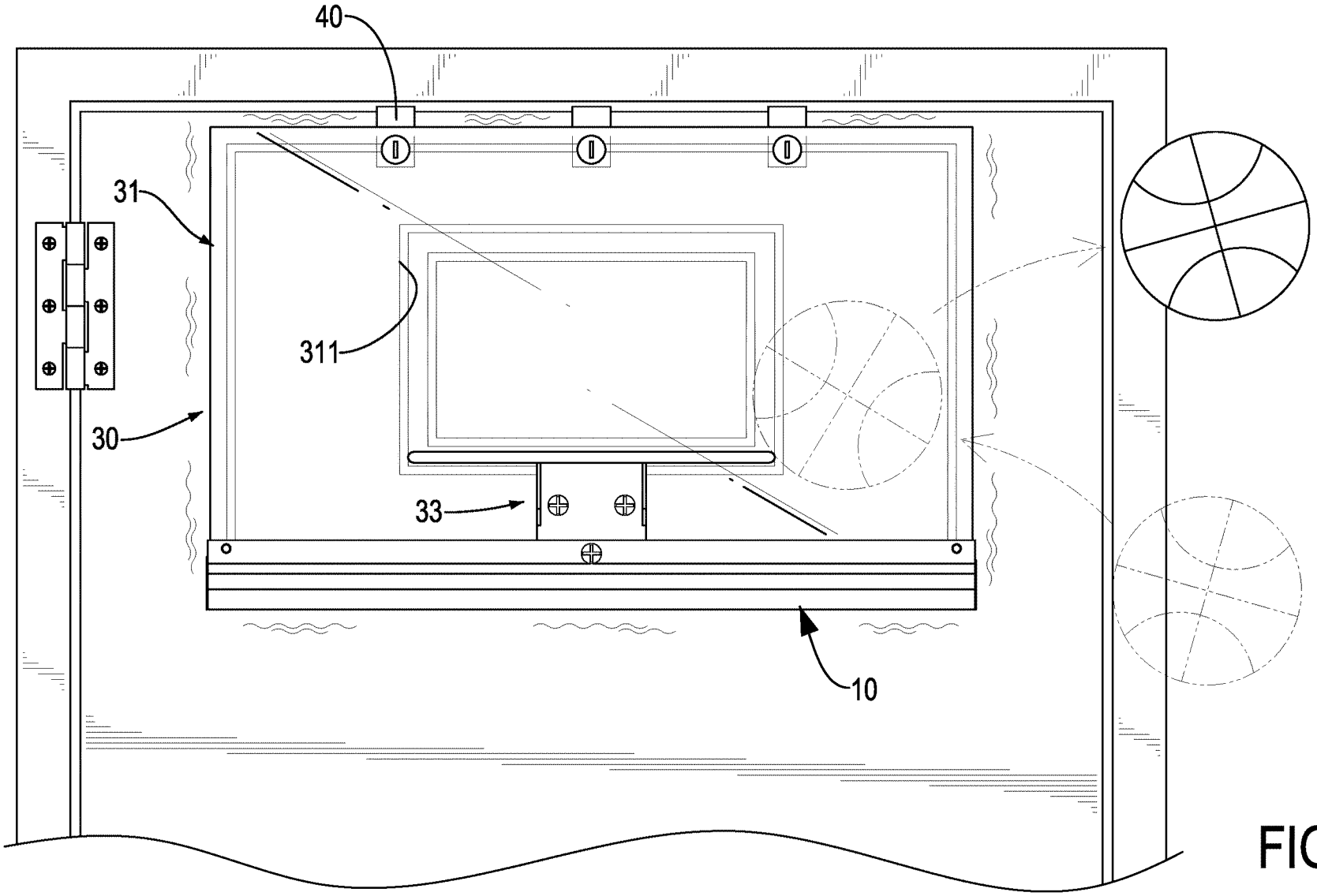
FIGS. 7 and 8 are operational front views of the basketball hoop set in FIG. 1.
Figure 8:
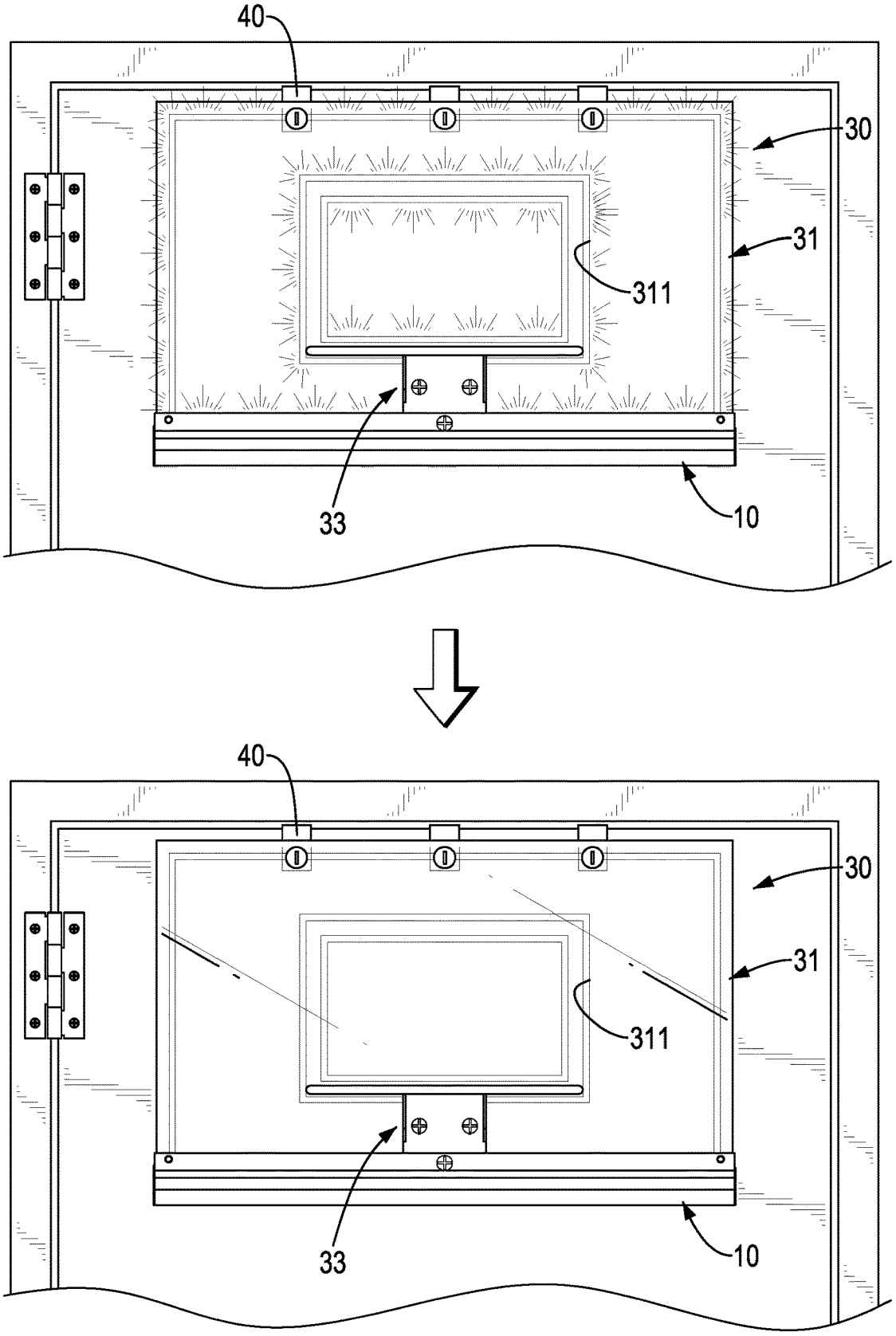

The light-transmitting backboard 31 may have at least one light-guiding groove 311. The at least one light-guiding groove 311 is recessed in a side of the light-transmitting backboard 31 away from the front rim 331. The at least one light-guiding groove 311 may be formed as multiple square frames, as the pattern of the target square, or other patterns. When the light source illuminates from a side of the light-transmitting backboard 31, the light-transmitting backboard 31 will guide the light, and the surface of the light-transmitting backboard 31 is illuminated. The light will be reflected and refracted at the light-guiding grooves 311, and the pattern of the light-guiding groove 311 will be highlighted. The light-transmitting backboard 31 may further have at least one hanging hole 313 formed through the light-transmitting backboard 31 near the top thereof. Thus, at least one hanging hook 40 can be mounted in the hanging hole 313 as shown in FIG. 7, and the basketball hook set in accordance with the present invention can be hung on a door panel.

With reference FIGS. 2 and 3, preferably, each of the opposite sides of the cavity 111 has a first fixing rib 113 and a second fixing rib 115. The first fixing ribs 113 and the second fixing ribs 115 extend along the longitudinal direction of the main body 11. The second fixing ribs 115 are located above and spaced from the first fixing ribs 113. The PCB 230 abuts on the first fixing ribs 113, and a longitudinal assembly position of the PCB 230 is limited by the end caps 12. The basketball hoop assembly 30 abuts on the second fixing ribs 115.

With reference to FIGS. 4, and 6 to 8, the illuminating module 20 will perform a determination method to turn on/off the LED module 25. The determination method is as follows. When the base 10 or the basketball hoop assembly 30 is hit by a basketball, the vibration sensor 231 detects the vibration and generates a vibration signal. If the MCU 233 receives the vibration signal for a first time, the MCU 233 generates a turn-on control signal to the LED module 25 to turn on the LED module 25. After that, if the MCU 233 does not receive the vibration signal again within a preset period of time, the MCU 233 generates a turn-off control signal to the LED module 25 to turn off the LED module 25.

The MCU 233 may process calculations and determinations according to a stored-in program command to generate different control signals according to time intervals between the vibration signals being input to the MCU 233, and controls the LED module 25 to perform different preset actions via the control signals. For example, if the MCU 233 receives the vibration signal for a first time, the MCU 233 generates a first control signal to the LED module 25 to perform a first preset action, such as turning on the LED module 25. After that, the MCU 233 determines if the MCU 233 receives the vibration signal again within a first preset period, such as receiving the vibration signal again within 5 seconds. If not, the MCU 233 generates a turn-off signal to LED module 25 to turn off the LED module 25. If yes, the MCU 233 generates a second control signal to the LED module 25 to perform a second preset action; for example, the LEDs 251 flash 3 times at intervals of 0.5 seconds and the LED module 25 is kept turned on. After that, the MCU 233 determines if the MCU 233 receives the vibration signal again within a second preset period, such as receiving the vibration signal within 20 seconds. If not, the MCU 233 generates a turn-off signal to turn off the LED module 25. If yes, the MCU 233 generates the second control signal to the LED module 25 to perform the second preset action, and then determines if the MCU 233 receives the vibration signal again within the second preset period again.

With such arrangements, when the basketball is shot to hit the basketball hoop set, the vibration sensor 231 generates the vibration signal by detecting impact vibration to turn on the light source. When the basketball hoop set is not in use after a preset period of time, the light source will be automatically turned off. The MCU 233 may have stored-in program commands to process calculations according to the vibration signal and time intervals of receiving the vibration signals to generate different control signals to control the LED module 25 to perform different preset actions. The surface of the light-transmitting backboard 31 can be illuminated by the LEDs 251 arranged at the side of the light-transmitting backboard 31, and the light-transmitting backboard 31 may be clearly displayed at night or in a dark place. The light-transmitting backboard 31 may further have a light-guiding groove 311 recessed therein. The pattern of the light-guiding groove 311 will be highlighted when illuminated. The basketball hoop set in accordance with the present invention can be used to play the basketball in a poorly lit place.

What is claimed is:

1. A luminous basketball hoop set comprising:

a base having a cavity recessed in the base and having a mouth formed in an end of the base;

an illuminating module mounted in the cavity of the base and having a power supply module;

a control circuit module electrically connected to the power supply module and having a vibration sensor generating a vibration signal by detecting a vibration; and a microcontroller unit (MCU) electrically connected to the vibration sensor and generating a control signal according to the vibration signal; and a light-emitting diode module (LED module) electrically connected to the control circuit module, receiving the control signal, and having at least one light-emitting diode (LED) facing the mouth of the base; and a basketball hoop assembly fixed in the base and having a light-transmitting backboard inserted in the cavity of the base via the mouth and being adjacent to the at least one LED of the LED module; and a rim assembly fixed on the light-transmitting backboard.

2. The luminous basketball hoop set as claimed in claim 1, wherein the light-transmitting backboard has at least one light-guiding groove recessed in the light-transmitting backboard.

3. The luminous basketball hoop set as claimed in claim 2, wherein the rim assembly has a front rim and a fixed base respectively disposed on opposite sides of the light-transmitting backboard.

4. The luminous basketball hoop set as claimed in claim 3, wherein the basketball hoop assembly has at least one cushion attached on a side of the basketball hoop assembly away from the front rim.

5. The luminous basketball hoop set as claimed in claim 4, wherein the base comprises a main body and two end caps, the cavity of the base is recessed in the main body and has two end openings respectively formed in longitudinal opposite ends of the main body, and the end caps respectively cover the opposite ends of the main body.

6. The luminous basketball hoop set as claimed in claim 5, wherein the light-transmitting backboard has at least one hanging hole formed through the light-transmitting backboard near a top of the light-transmitting backboard.

7. The luminous basketball hoop set as claimed in claim 6, wherein the power supply module is a battery module.

8. The luminous basketball hoop set as claimed in claim 1, wherein the illuminating module performs a determination method comprising steps of:

receiving the vibration signal for a first time, the MCU generating a turn-on control signal; and determining whether the MCU receives the vibration signal again within a preset period of time, if not, the MCU generating a turn-off control signal.

9. The luminous basketball hoop set as claimed in claim 2, wherein the illuminating module performs a determination method comprising steps of:

receiving the vibration signal for a first time, the MCU generating a turn-on control signal; and determining whether the MCU receives the vibration signal again within a preset period of time, if not, the MCU generating a turn-off control signal.

10. The luminous basketball hoop set as claimed in claim 3, wherein the illuminating module performs a determination method comprising steps of:

receiving the vibration signal for a first time, the MCU generating a turn-on control signal; and determining whether the MCU receives the vibration signal again within a preset period of time, if not, the MCU generating a turn-off control signal.

11. The luminous basketball hoop set as claimed in claim 4, wherein the illuminating module performs a determination method comprising steps of:

receiving the vibration signal for a first time, the MCU generating a turn-on control signal; and determining whether the MCU receives the vibration signal again within a preset period of time, if not, the MCU generating a turn-off control signal.

12. The luminous basketball hoop set as claimed in claim 5, wherein the illuminating module performs a determination method comprising steps of:

receiving the vibration signal for a first time, the MCU generating a turn-on control signal; and determining whether the MCU receives the vibration signal again within a preset period of time, if not, the MCU generating a turn-off control signal.

13. The luminous basketball hoop set as claimed in claim 6, wherein the illuminating module performs a determination method comprising steps of:

receiving the vibration signal for a first time, the MCU generating a turn-on control signal; and determining whether the MCU receives the vibration signal again within a preset period of time, if not, the MCU generating a turn-off control signal.

14. The luminous basketball hoop set as claimed in claim 7, wherein the illuminating module performs a determination method comprising steps of:

receiving the vibration signal for a first time, the MCU generating a turn-on control signal; and determining whether the MCU receives the vibration signal again within a preset period of time, if not, the MCU generating a turn-off control signal.

15. The luminous basketball hoop set as claimed in claim 1, wherein the illuminating module performs a determination method comprising steps of:

receiving the vibration signal for a first time, the MCU generating a first control signal to the LED module to perform a first preset action;

determining whether the MCU receives the vibration signal again within a first preset period of time, if not, the MCU generating a turn-off control signal, and if yes, the MCU generating a second control signal to the LED module to perform a second preset action; and determining whether the MCU receives the vibration signal again within a second preset period of time, if not, the MCU generating a turn-off control signal, and if yes, the MCU generating the second control signal to the LED module to perform the second preset action and then determining whether the MCU receives the vibration signal again within the second preset period of time.

16. The luminous basketball hoop set as claimed in claim 2, wherein the illuminating module performs a determination method comprising steps of:

receiving the vibration signal for a first time, the MCU generating a first control signal to the LED module to perform a first preset action;

determining whether the MCU receives the vibration signal again within a first preset period of time, if not, the MCU generating a turn-off control signal, and if yes, the MCU generating a second control signal to the LED module to perform a second preset action; and determining whether the MCU receives the vibration signal again within a second preset period of time, if not, the MCU generating a turn-off control signal, and if yes, the MCU generating the second control signal to the LED module to perform the second preset action and then determining whether the MCU receives the vibration signal again within the second preset period of time.

17. The luminous basketball hoop set as claimed in claim 3, wherein the illuminating module performs a determination method comprising steps of:

receiving the vibration signal for a first time, the MCU generating a first control signal to the LED module to perform a first preset action;

determining whether the MCU receives the vibration signal again within a first preset period of time, if not, the MCU generating a turn-off control signal, and if yes, the MCU generating a second control signal to the LED module to perform a second preset action; and determining whether the MCU receives the vibration signal again within a second preset period of time, if not, the MCU generating a turn-off control signal, and if yes, the MCU generating the second control signal to the LED module to perform the second preset action and then determining whether the MCU receives the vibration signal again within the second preset period of time.

18. The luminous basketball hoop set as claimed in claim 4, wherein the illuminating module performs a determination method comprising steps of:

receiving the vibration signal for a first time, the MCU generating a first control signal to the LED module to perform a first preset action;

determining whether the MCU receives the vibration signal again within a first preset period of time, if not, the MCU generating a turn-off control signal, and if yes, the MCU generating a second control signal to the LED module to perform a second preset action; and determining whether the MCU receives the vibration signal again within a second preset period of time, if not, the MCU generating a turn-off control signal, and if yes, the MCU generating the second control signal to the LED module to perform the second preset action and then determining whether the MCU receives the vibration signal again within the second preset period of time.

19. The luminous basketball hoop set as claimed in claim 5, wherein the illuminating module performs a determination method comprising steps of:

receiving the vibration signal for a first time, the MCU generating a first control signal to the LED module to perform a first preset action;

determining whether the MCU receives the vibration signal again within a first preset period of time, if not, the MCU generating a turn-off control signal, and if yes, the MCU generating a second control signal to the LED module to perform a second preset action; and determining whether the MCU receives the vibration signal again within a second preset period of time, if not, the MCU generating a turn-off control signal, and if yes, the MCU generating the second control signal to the LED module to perform the second preset action and then determining whether the MCU receives the vibration signal again within the second preset period of time.

20. The luminous basketball hoop set as claimed in claim 6, wherein the illuminating module performs a determination method comprising steps of:

receiving the vibration signal for a first time, the MCU generating a first control signal to the LED module to perform a first preset action;

determining whether the MCU receives the vibration signal again within a first preset period of time, if not, the MCU generating a turn-off control signal, and if yes, the MCU generating a second control signal to the LED module to perform a second preset action; and determining whether the MCU receives the vibration signal again within a second preset period of time, if not, the MCU generating a turn-off control signal, and if yes, the MCU generating the second control signal to the LED module to perform the second preset action and then determining whether the MCU receives the vibration signal again within the second preset period of time.

* * * * *